US006354288B1

(12) United States Patent
McDonald

(10) Patent No.: US 6,354,288 B1
(45) Date of Patent: Mar. 12, 2002

(54) PORTABLE FIREPLACE

(76) Inventor: Timothy W. McDonald, 16702 Halkin Ct., Spring, TX (US) 77379

( * ) Notice: Subject to any disclaimer, the term of this patent is extended or adjusted under 35 U.S.C. 154(b) by 0 days.

(21) Appl. No.: 09/573,585

(22) Filed: May 18, 2000

(51) Int. Cl.[7] ..... F24C 3/04; F24B 1/181

(52) U.S. Cl. ..... 126/519; 126/500; 126/512; 431/125; 431/253

(58) Field of Search ..... 126/519, 503, 126/513, 500, 8, 9 R, 144, 26, 25 R, 29, 30, 512, 39 R, 41 R; 431/125, 253

(56) References Cited

U.S. PATENT DOCUMENTS 607,642 A * 7/1898 Botelh
3,327,698 A * 6/1967 Leslie
3,830,217 A * 8/1974 Maness et al. ..... 126/519
3,868,943 A * 3/1975 Hottenroth et al. ..... 126/25 R
3,910,251 A * 10/1975 Andrew ..... 126/519
4,173,967 A * 11/1979 Brown ..... 126/541
4,727,698 A * 3/1988 Altman ..... 126/500
4,909,235 A * 3/1990 Boetcker et al. ..... 126/25 R
5,024,208 A * 6/1991 Hottenroth et al. ..... 126/25 R
5,299,103 A * 3/1994 Kielland ..... 362/101
5,598,834 A 2/1997 Grady ..... 126/506
5,797,386 A * 8/1998 Orr ..... 126/25 R
5,868,128 A * 2/1999 Omar ..... 126/519
5,901,697 A * 5/1999 Oliver, Jr. et al. ..... 126/519

OTHER PUBLICATIONS

U.S.S.N. 09/573,585: Admitted prior art set forth on p. 1, lines 19–22.

* cited by examiner

*Primary Examiner*—Carl D. Price
(74) *Attorney, Agent, or Firm*—Browning Bushman P.C.

(57) ABSTRACT

A portable fireplace having an inner housing defined by an inner housing wall and forming a flame pit, an outer housing having an outer housing wall, the outer housing and the inner housing being interconnected to one another, the outer housing being in surrounding relationship to the inner housing, at least the majority of the walls of the inner and outer housings being spaced from one another to provide an insulation space and a support disposed in the flame pit for supporting a flame presentation substance.

19 Claims, 4 Drawing Sheets

PORTABLE FIREPLACE

BACKGROUND OF THE INVENTION

1. Field of the Invention

The present invention relates to portable fireplaces and, more particularly, to portable, outdoor fireplaces.

2. Description of the Prior Art

The entertaining of friends, guests, and families in the home is becoming more and more informal. Thus, formal dinners, cocktail parties, and the like are being eschewed in favor of casual entertaining on decks, patios, and the like. This tendency toward more casual entertaining is reflected in the rapid increase in the number of what might be called "outdoor kitchens," some of which are quite elaborate and can include grills, ovens, rotisseries, and, in certain cases, fireplaces.

For the most part, indoor fireplaces serve more of an aesthetic than a functional purpose and, because of the ambience they create, often serve as a focal point of any indoor gathering of family and/or guests. Likewise, an outdoor fireplace erected on a patio, deck, or the like serves as a focal point for outdoor gatherings.

It is known to erect a permanent outdoor fireplace using firebrick or a steel housing to form a firebox, which generally opens the top. Generally, the top edge of the firebox and its outer, peripheral surface are veneered with more decorative materials, such as natural or artificial stone. However, such permanently constructed fireplaces must be custom built and, accordingly, are expensive. Moreover, they cannot be moved, which severely limits one's ability to rearrange the outdoor setting to suit one's changing tastes. Accordingly, a portable fireplace that could be readily shipped and moved from location to location with a minimum amount of difficulty is clearly desirable.

SUMMARY OF THE INVENTION

It is therefore an object of the present invention to provide a portable fireplace.

Another object of the present invention is to provide a portable fireplace that can utilize wood or is gas-fired.

Still a further object of the present invention is to provide a portable fireplace that is both functional and aesthetically pleasing.

Yet a further object of the present invention is to provide a portable fireplace that can be made from a variety of decorative materials.

Another object of the present invention is to provide a portable fireplace in which the external appearance of at least a portion of the fireplace can be easily varied.

The above and other objects of the present invention will become apparent from the drawings, the description given herein, and the appended claims.

The portable fireplace of the present invention comprises an inner housing having an upper end, a lower end, and an inner housing wall having an inner wall surface and an outer wall surface, the inner housing defining a flame pit. There is an outer housing having an upper end, a lower end, and an outer housing wall having an inner wall surface and an outer wall surface, the outer housing preferably being interconnected and in surrounding relationship to the inner housing, the majority of the outer wall surface of the inner housing wall being spaced from the inner wall surface of the outer housing wall. A support is disposed in the flame pit for supporting a flame presentation substance.

DESCRIPTION OF THE PREFERRED EMBODIMENTS

Figure 1:
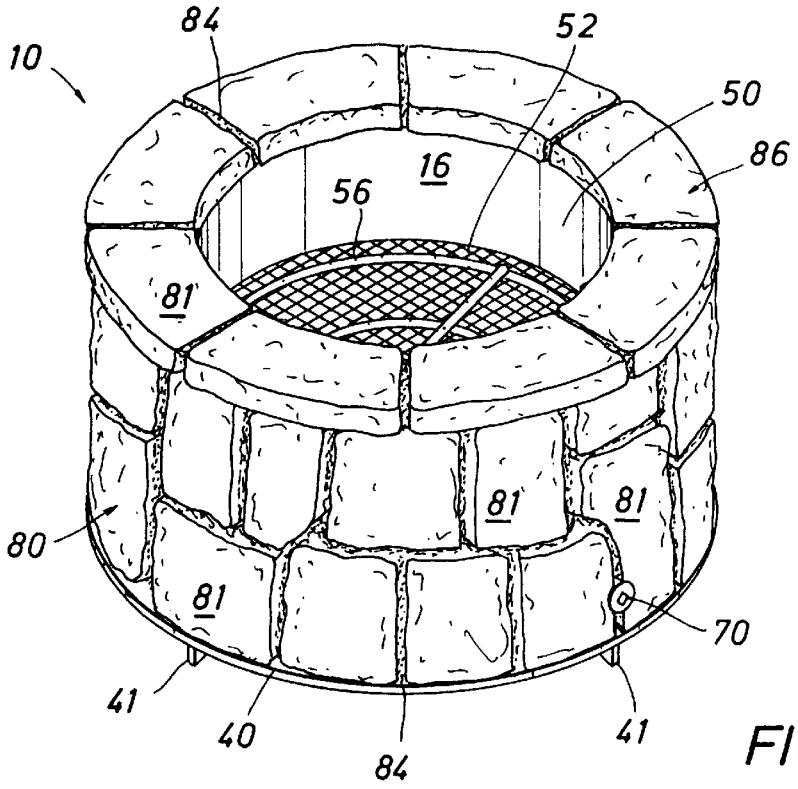
FIG. 1 is a perspective view of one embodiment of the portable fireplace of the present invention.
Figure 2:
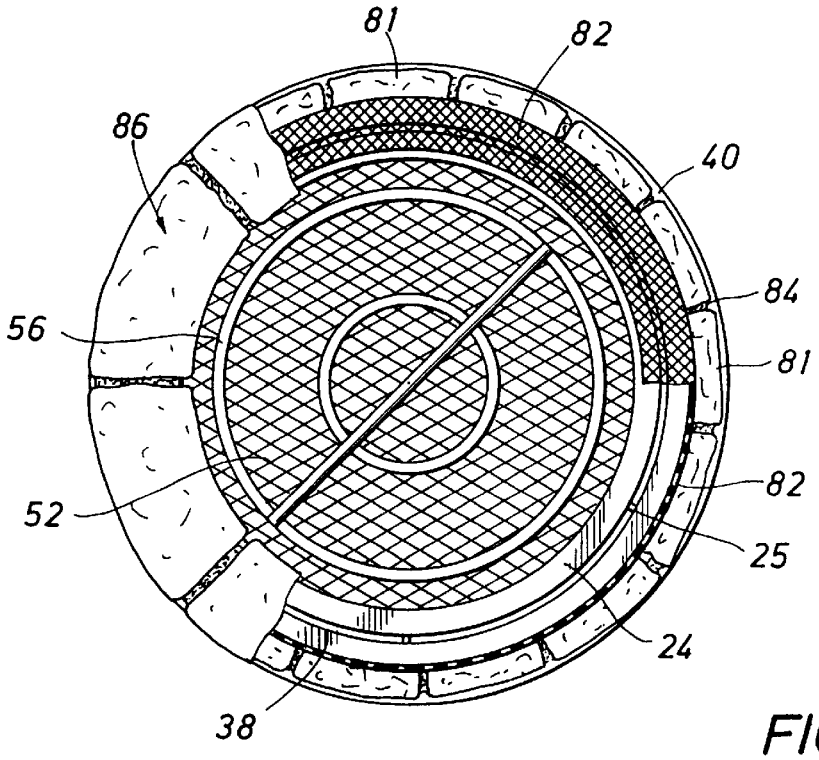
FIG. 2 is a top, plan view, partially in section, of the portable fireplace shown in FIG. 1.
Figure 3:
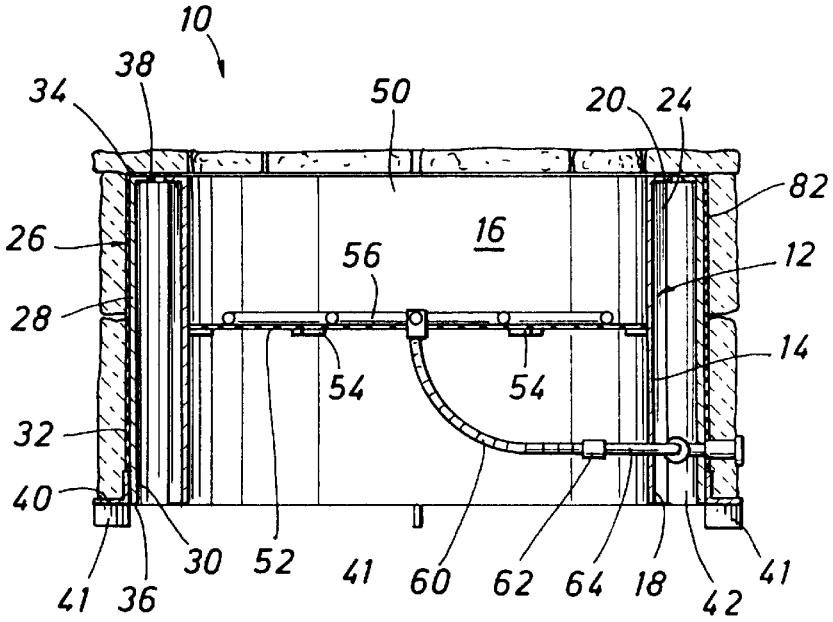
FIG. 3 is an elevational view, partially in section, of the portable fireplace shown in FIG. 1.
Figure 4:
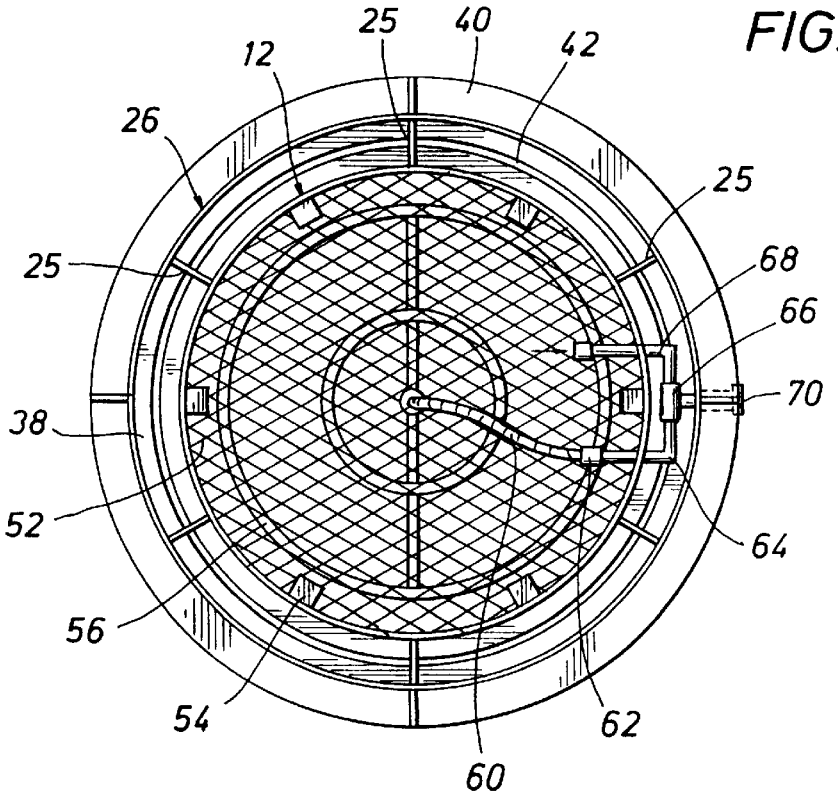
FIG. 4 is a bottom plan view of the portable fireplace shown in FIG. 1 showing in greater detail the connection of a gas source.

With reference now to FIGS. 1–4, the portable fireplace, shown generally as 10, has an inner housing, shown generally as 12, comprised of an inner housing wall 14 having an inner wall surface 16 and an outer wall surface 18. Inner housing 12 also has an upper end 20, a lower end 22, and a laterally outwardly projecting, peripherally extending flange 24 depending from upper end 20. Portable fireplace 10 further comprises an outer housing, shown generally as 26 and comprising an outer housing wall 28 having an inner wall surface 30 and an outer wall surface 32. Outer housing 26 has an upper end 34 and a lower end 36. A laterally inwardly projecting, peripherally extending flange 38 extends from top end 34, while a laterally outwardly projecting, peripherally extending flange 40 depends from bottom end 36. Secured to flange 39 are a series of legs 41 to raise fireplace 10 off the support surface. It will thus be seen that inner housing 12 and outer housing 26 form a space 42 therebetween, space 42 effectively serving as an insulating airspace such that outer housing 26 remains cool relative to inner housing 12. While housings 12 and 26 are shown as being substantially cylindrical, it is to be understood that inner housing and outer housing can take a variety of shapes. Thus, it will be apparent that portable fireplace 10 can be made so as to be rectangular, hexagonal, kidney-shaped, or the like. In the embodiment of the portable fireplace shown in FIGS. 1–4, inner housing 12 is interconnected to outer housing 26 by means of ribs 25 that are spaced around the periphery of inner housing 12 and that are welded, or otherwise attached, to inner housing 12 and outer housing 26. It will be appreciated that instead of feet 41 attached to flange 40, ribs 25 could be extended below the lower end 18 of housing 12 to form a series of peripherally spaced lips. However, whatever the configuration, it is desired that, for at least the most part, the outer wall surface 18 of inner housing 12 be spaced from the inner wall surface 30 of outer housing 26. Thus, while inner housing wall 14 and outer housing wall 26 can be at least partially in contact, it is preferable that they be spaced to eliminate heat conduction from inner housing wall 14 to outer housing wall 28. While spacing between inner housing 12 and outer housing 26 serves to provide air insulation to prevent outer housing 26 from becoming excessively hot, it will be appreciated that the space between the inner and outer housings could be filled with a heat-resistant insulation, e.g., a heat-resistant foam insulation.

Inner housing 12 defines a fire or flame pit 50 in which is disposed a grate 52, grate 52 resting on dogs 54 secured to inner wall surface 16 of inner housing wall 14, dogs 54 being spaced at intervals around the periphery of wall surface 16. Resting on grate 52 is a fire ring 56, which, as well known to those skilled in the art, comprises a series of interconnected tubes forming a manifold having perforations that allow gas being fed to fire ring 56 to exit and be ignited by a suitable ignition source. Fire ring 56 is connected to a flex conduit 60, which in turn is connected by means of coupling 62 to an elbow 64. Elbow 64 is in turn connected to a gas valve 66. A second elbow 68 connects to a source of gas, such as a propane tank, a natural gas line, or the like (none of which are shown). Thus, valve 66 serves to control gas flow from elbow 68 into elbow 64, flex conduit 60, and fire ring 56. To operate gas valve 66, a suitable valve key is inserted into valve key receptacle 70, as is well understood by those skilled in the art.

As best seen in FIG. 1, the portable fireplace of the present invention carries a decorative motif in the form of a veneer or overlay 80 that, in the embodiment shown in FIGS. 1–4, comprises sections 81 of a stonelike material, which can be either natural or synthetic and which cover the outer housing 26 and flanges 24 and 38. To securely adhere the section 81 to portable fireplace 10, a metallic mesh 82 is secured to outer wall surface 32 of outer housing wall 28 and is lipped over the top end so as to overlie the top surfaces of flanges 38 and 24, which basically form support surfaces for veneer 80. As is well known to those skilled in the art, the veneer sections 81 can be securely held to the outer wall surface 32 of outer housing wall 28 and to flanges 24 and 38 by means of adhesives commonly used to secure stone, tile, or various other ceramics and plastics to a surface to be decorated. The wire mesh 82 serves to aid in bonding the sections 81 to the respective surfaces. Once the sections 81 have been applied, grout 84 can be used to fill the spaces between the sections 81. As best seen in FIG. 1, a top ledge 86 is formed by the sections 81. It can thus be seen that flange 40 serves a dual purpose of forming a peripheral support ledge on which sections 81 can rest and also functions, in conjunction with flanges 24 and 38, to impart rigidity to the portable fireplace 10, effectively preventing any significant movement of the outer housing 26, which in turn prevents sections 81 from cracking or detaching from outer housing 26.

Grate 52, which could be permanently secured to inner housing 12, but which as shown is removable, acts in conjunction with dogs 54 as a support for a suitable flame presentation substance. As used herein, the term "flame presentation substance" is intended to include wood, lava rocks, artificial logs, and the like. In the case of natural wood, the burning wood itself presents the flame, whereas in the case of lava rocks, artificial logs, or the like, and when portable fireplace 10 is gas-fired, the lava rocks, logs, or the like serve to provide a flame presentation that appears as naturally burning wood, as opposed to that which would be achieved if the ignited gas were simply issuing from the fire ring 56 and there were no substance to disperse the flames. It will be understood, however, that it is within the scope of the present invention to construct a gas or fire ring that, in and of itself, functions as a flame presentation substance, e.g., provides an aesthetically pleasing flame pattern.

In cases where it is desired to burn natural wood, the fire ring 56 and the attendant gas hookup plumbing could be eliminated, although it will be obvious that even if the portable fireplace 10 were connected to a flammable gas source, natural wood could still be employed as a flame presentation substance, the gas initially being used to light the natural wood and then being turned off to allow the wood to burn on its own.

It should be noted that because the flame pit 50 is open from the top to the bottom of the portable fireplace 10, and because the portable fireplace 10 is raised off of the surface upon which it is sitting by the legs 41, ample air is drawn into the bottom of the flame pit 50 so as to readily sustain the burning of natural wood.

With reference now to FIGS. 5–8, there is shown another embodiment of the portable fireplace of the present invention. Fireplace 90 comprises an inner housing 92 having an inner housing wall 94, inner housing wall 94 having an inner wall surface 96 and an outer wall surface 98. Housing 92 also has an upper end 100 and a lower end 102, a laterally outwardly projecting, peripherally extending flange 104 depending from upper end 100. Portable fireplace 90 further includes an outer housing 106 having an outer housing wall 108, wall 108 having an inner wall surface 110 and an outer wall surface 112. Outer housing 106 also has an upper end 114 and a lower end 116.

Figure 8:
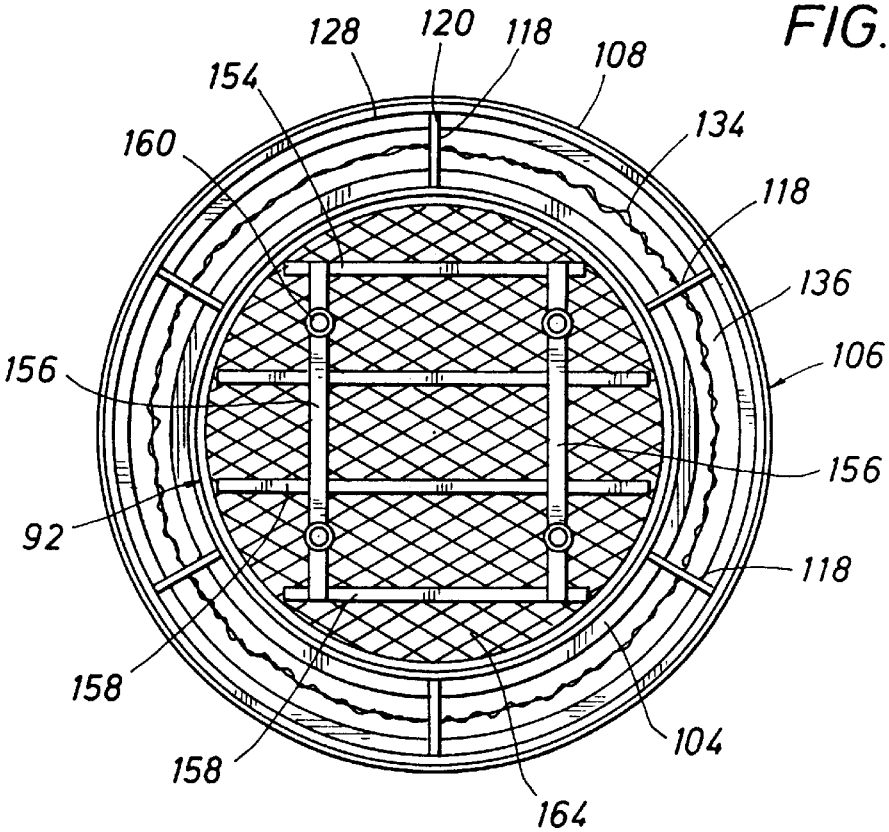
FIG. 8 is a bottom plan view of the portable fireplace shown in FIG. 5.

A series of ribs 118 are secured to outer surface 98 of inner housing wall 94, ribs 118 being spaced around the periphery of wall 94, as best shown in FIG. 8. Ribs 118 have a lower end 120 and an upper end 122, the lower ends 120 forming legs for portable fireplace 90. Secured to the upper end 122 of ribs 118 is a peripherally extending L-angle iron 124, L-angle iron 124 providing a laterally inwardly projecting, peripherally extending flange 126. Secured to ribs 118 adjacent their lower ends 120 is a peripherally extending band 128. It will be understood that flange 104, L-angle iron 124, and band 128 in conjunction with ribs 118 provide a rigid structural framework.

Figure 5:
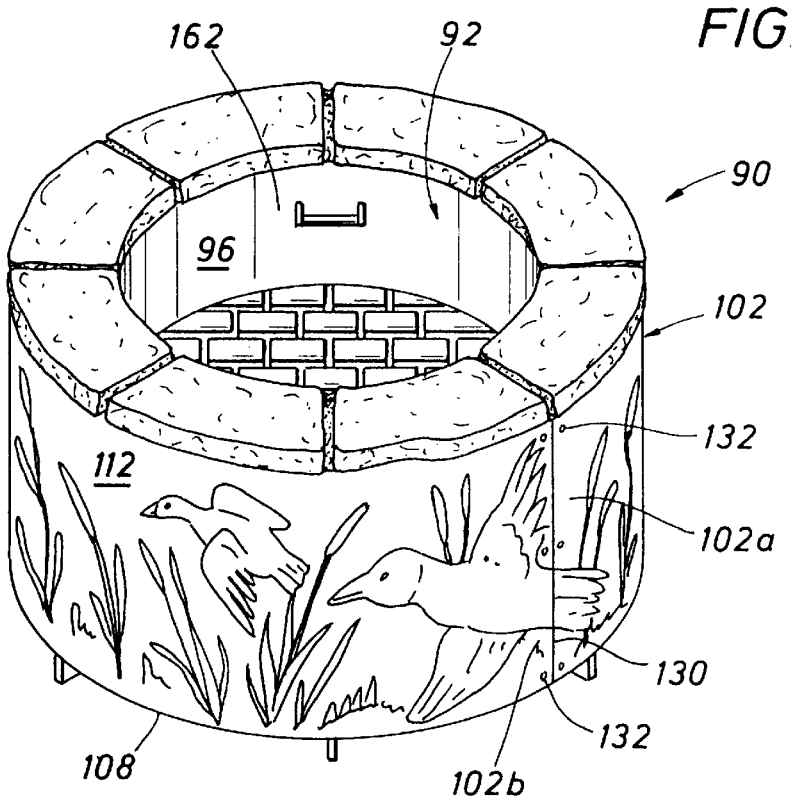
FIG. 5 is a perspective view of another embodiment of the portable fireplace of the present invention.
Figure 6:
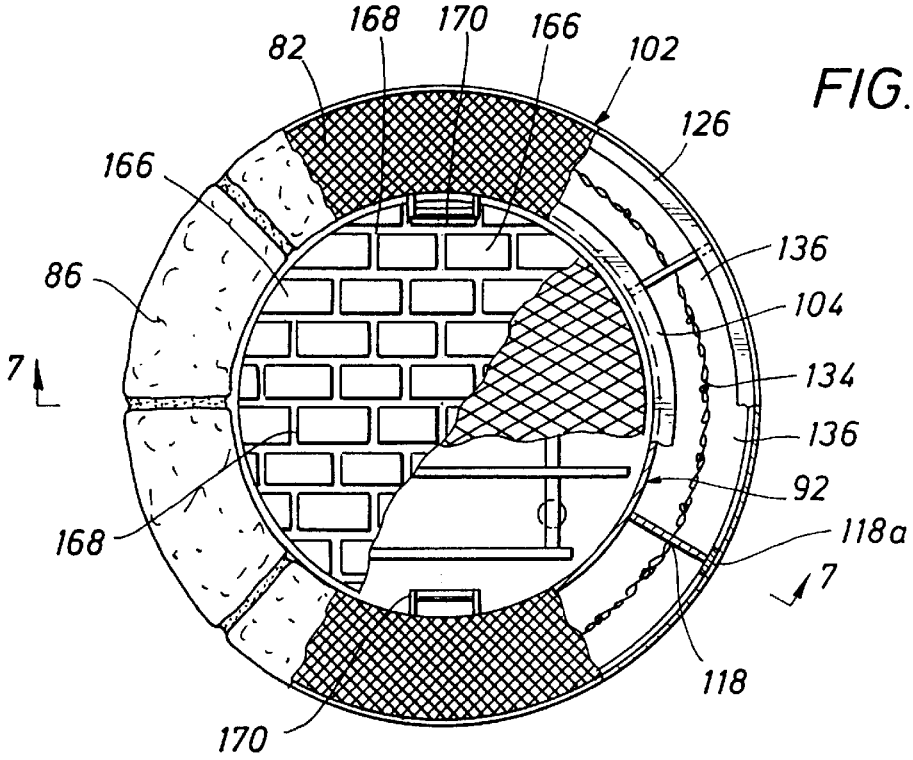
FIG. 6 is a top plan view, partially in section, of the portable fireplace shown in FIG. 5.
Figure 7:
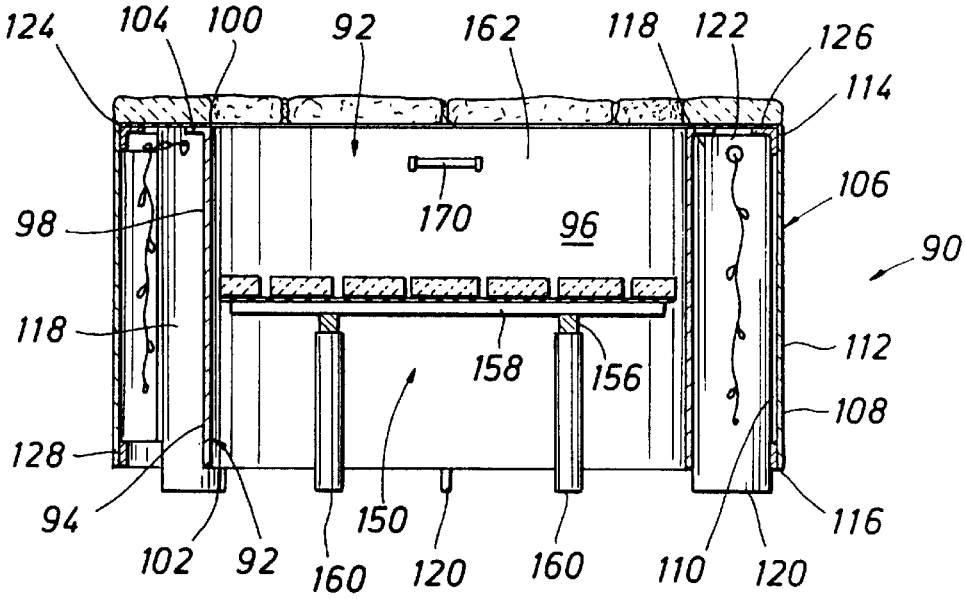
FIG. 7 is an elevated view, partially in section, of the portable fireplace shown in FIG. 5.

As best seen with reference to FIGS. 5 and 6, outer housing 102 is not continuous, as is housing 26, but rather is split to provide a first end 102*a* and a second end 102*b*. When outer housing wall 108 is wrapped around the periphery of portable fireplace 90 to form outer housing 102, ends 102*a* and 102*b* abut to form a seam 130. To secure housing 102 to portable fireplace 90, a series of sheet metal screws 132 or the like are received through wall 108 and threaded into registering holes (not shown) in a faceplate 118 secured to the outermost edge of one of the ribs 118. Additional such screws can be received through wall 108 and threaded into holes in L-angle iron 124 and/or band 128. It will thus be seen that outer housing 102 can be easily removed and replaced simply by removing screws 132.

As best seen with reference to FIG. 5, outer wall surface 112 of outer housing wall 108 provides a decorative motif of flying ducks. Indeed, one of the advantages of portable fireplace 90 is the fact that the decorative motif can be changed simply by removing outer housing 102 and replacing it with an outer housing having a different decorative motif. Thus, as will be appreciated by those skilled in the art, a virtually endless variety of decorative motifs could be provided, including, for example, a Christmas motif, university emblems, hunting or fishing scenes, etc.

The decorative motif provided by the outer housing 102 can be formed in a variety of ways, such as embossing, silk-screening, etc. A particularly desirable decorative motif is obtained by forming a series of openings through outer housing wall 108, the openings, e.g., small holes or cuts, forming a desired pattern. Thus, for example, the flying duck motif shown in FIG. 5 could be formed by a series of computer-generated, tiny holes or cuts through outer housing wall 108. In particular, by forming the decorative motif in such a manner, a particularly pleasing effect can be obtained due to the fact that an illumination source, such as a string of lights 134, can be disposed in the space 136 between outer housing 102 and inner housing 92. It will thus be appreciated that at night, with the lights 134 illuminated, the decorative motif formed by the tiny holes or perforations in wall 108 will be visible.

It will be appreciated that outer housing 102 can simply be formed of certain metals that, in and of themselves or because of surface treatment, provide a decorative motif. Thus, housing 102 could be made of copper, brushed aluminum, stainless steel, brushed stainless steel, etc. Accordingly, the term "decorative motif," in addition to a veneer as described above, is intended to include any type of surface finish—e.g., embossing or engraving—surface appliques, stamping, cutting, perforating, or any other treatment on or in the outer housing that provides an aesthetic appearance, it being understood that aesthetics, as beauty, is in the eye of the beholder.

While portable fireplace 10 shown in FIGS. 1–4 has a grate that is attached, albeit removably, to the inner housing 12, portable fireplace 90 differs in that the support for the flame presentation material is not attached to inner housing, but rather is freestanding relative to portable fireplace 90. The fire presentation material support of the embodiment of FIGS. 5–8 is shown generally as 150 and comprises a grid 154 comprised of lower support members 156, to which are secured upper cross members 158. Attached to support members 156 are a series of pedestals 160 that effectively raise support 150 to a desired level in the flame pit 162 formed by inner housing 92. Disposed on cross members 158 is an expanded metal grate 164. Grate 164 has an upper surface to which are attached, by a suitable heat-resistant adhesive, blocks 166 of a refractory material, such as firebrick. It will be observed that the bricks 166 are not mortared, thereby providing channels 168 therebetween. Accordingly, since the grate 164 is likewise of open construction, the support 150 is effectively provided with air passages therethrough.

It will readily be seen that portable fireplace 90 can easily be moved from location to location with a minimum amount of effort. To this end, handles 170 are secured at diametrically opposed positions to the inner wall surface 96. Thus, handles 170 can be grasped and portable fireplace 90 raised upwardly, leaving support 150 exposed. Support 150 can then be moved to a desired location and portable fireplace 90 repositioned over support 150 such that support 150 is again received in flame pit 162.

As in the case of the portable fireplace shown in FIGS. 1–4, portable fireplace 90 can also be provided with a decorative top surface or ledge 86 secured to portable fireplace 90 in the same manner as described above with respect to portable fireplace 10.

It is within the purview of the present invention that the flame presentation substance support can simply be blocks of firebrick or other refractory material that serves to provide a raised locus in the flame pit upon which a flame presentation substance can be positioned.

While portable fireplace 90, as shown, has a split out wall forming the outer housing, it will be understood that the outer housing could be a continuous piece, e.g., cylindrical. In this case, the outer housing could be positioned on a support surface, e.g., a patio, and the remainder of portable fireplace 90 positioned inside of the outer housing, which, if desired, could be attached as by screws or the like to the frameworks described above.

It will be understood that the portable fireplace shown in FIGS. 5–8 could be gas-fired if desired, e.g., by resting a fire ring on the refractory blocks 166.

The foregoing description and examples illustrate selected embodiments of the present invention. In light thereof, variations and modifications will be suggested to one skilled in the art, all of which are in the spirit and purview of this invention.

What is claimed is:

1. A portable fireplace, comprising:

an inner, metallic housing having an upper end, a lower end, and a peripherally extending inner housing wall having an inner wall surface and an outer wall surface and defining a flame pit, at least a portion of said flame pit being open from said upper end of said housing to said lower end of said housing whereby air can be drawn through said flame pit;

an outer, metallic housing having an upper end, a lower end, and a peripherally extending outer housing wall having an inner wall surface and an outer wall surface, said outer housing being in surrounding relationship to said inner housing, the majority of said outer wall surface of said inner housing wall being spaced from said inner wall surface of said outer housing wall;

a laterally projecting, peripherally extending flange being attached to the upper end of at least one of said inner housing or said outer housing, wherein if said flange is attached to the upper end of said outer housing, said flange projects toward said inner housing, and if said flange is attached to the upper end of said inner housing, said flange projects toward said outer housing;

a decorative veneer carried by said flange, and a support disposed in said flame pit for supporting a flame presentation substance.

2. A portable fireplace, comprising:

an inner, metallic housing having an upper end, a lower end, and a peripherally extending inner housing wall having an inner wall surface and an outer wall surface and defining a flame pit, at least a portion of said flame pit being open from said upper end of said housing to said lower end of said housing whereby air can be drawn through said flame pit;

an outer, metallic housing having an upper end, a lower end, and a peripherally extending outer housing wall having an inner wall surface and an outer wall surface, said outer housing being in surrounding relationship to said inner housing, the majority of said outer wall surface of said inner housing wall being spaced from said inner wall surface of said outer housing wall;

said upper end of said inner housing having a laterally outwardly projecting, peripherally extending first flange and said upper end of said outer housing having a laterally inwardly projecting, peripherally extending second flange, said first and second flanges forming support surfaces;

a decorative motif carried by at least one of said support surfaces; and a support disposed in said flame pit for supporting a flame presentation substance.

3. The portable fireplace of claim 2 wherein there is a wire mesh covering over said outer wall surface of said outer housing wall and said support surfaces and there is a decorative motif carried by said outer wall surface of said outer housing and said support surfaces.

4. A portable fireplace, comprising:

an inner, metallic housing having an upper end, a lower end, and a peripherally extending inner housing wall having an inner wall surface and an outer wall surface and defining a flame pit, at least a portion of said flame pit being open from said upper end of said housing to said lower end of said housing whereby air can be drawn through said flame pit;

an outer, metallic housing having an upper end, a lower end, and a peripherally extending outer housing wall having an inner wall surface and an outer wall surface, said outer housing being in surrounding relationship to said inner housing, the majority of said outer wall surface of said inner housing wall being spaced from said inner wall surface of said outer housing wall; and a support disposed in said flame pit for supporting a flame presentation substance, said support comprising a free-standing structure.

5. The portable fireplace any of claim 1 or 2 wherein said support comprises a grate mounted in said inner housing intermediate said upper end and said lower end of said inner housing.

6. The portable fireplace of claim 5 wherein there is a fire ring disposed on said grate.

7. The portable fireplace of claim 6 wherein there is a source of flammable gas connected to said fire ring.

8. The portable fireplace any of claims 1 or 2 wherein said inner housing and said outer housing arc interconnected to one another.

9. The portable fireplace of either of claims 1 or 2 wherein said decorative motif comprises a stonelike material.

10. The portable fireplace claim 9 wherein said stonelike material is natural.

11. The portable fireplace of claim 9 wherein said stonelike material is artificial.

12. The portable fireplace of any of claims 1 or 2 wherein said decorative motifis formed by a plurality of openings extending through said outer housing wall.

13. The portable fireplace of claim 12 wherein there is an illumination source disposed between said inner housing and said outer housing.

14. A portable fireplace, comprising;

an inner, metallic housing having an upper end, a lower end, and a peripherally extending inner housing wall having an inner wall surface and an outer wall surface and defining a flame pit, at least a portion of said flame pit being open from said upper end of said housing to said lower end of said housing whereby air can be drawn through said flame pit;

an outer, metallic housing having an upper end, a lower end, and a peripherally extending outer housing wall having an inner wall surface and an outer wall surface, said outer housing being in surrounding relationship to said inner housing, the majority of said outer wall surface of said inner housing wall being spaced from said inner wall surface of said outer housing wall, said outer housing being removably interconnected to said inner housing, said outer housing wall carrying a decorative motif; and support disposed in said flame pit for supporting a flame presentation substance.

15. The portable fireplace of claim 14 wherein said freestanding structure includes a grate, said grate having legs to position said grate intermediate said upper end and said lower end of said inner housing.

16. The portable fireplace claim 15 wherein said grate forms a top surface and there is refractory material secured to said upper surface of said grate, said refractory material and said grate cooperating to form air passageways.

17. The portable fireplace of claim 16 wherein said refractory material comprises a plurality of firebricks secured to said top surface of said grate.

18. The portable fireplace any of claims 1, 2, or 4 wherein said inner housing and said outer housing are generally cylindrical and substantially concentric with respect to one another.

19. The portable fireplace any of claims 1, 2, or 4 wherein said lower end of said outer housing has a laterally outwardly projecting, peripherally extending flange.

* * * * *